US006022298A

United States Patent [19]

Svedarsky et al.

[11] Patent Number: 6,022,298

[45] Date of Patent: Feb. 8, 2000

[54] EXERCISE DEVICE

[76] Inventors: Alex Svedarsky, SJO-3018 NW. 97th Ave., Unit C-101, P.O. Box 025216, Miami, Fla. 33102; R. Michael Webb, 908 Domnus #203, Las Vegas, Nev. 89134

[21] Appl. No.: 09/253,683

[22] Filed: Feb. 19, 1999

[51] Int. Cl.[7] ..... A63B 23/04; A63B 21/06; A63B 21/05

[52] U.S. Cl. ..... 482/97; 482/130; 482/137

[58] Field of Search ..... 482/97, 100, 101, 482/129, 130, 135, 137, 128; D21/673, 675

[56] References Cited

U.S. PATENT DOCUMENTS

| | | | |
|---|---|---|---|
| 4,357,010 | 11/1982 | Telle | 482/97 |
| 4,492,375 | 1/1985 | Connelly | 482/130 |
| 4,674,160 | 6/1987 | Gibson . | |
| 4,795,149 | 1/1989 | Pearson . | |
| 4,923,195 | 5/1990 | Calderone . | |
| 5,108,095 | 4/1992 | Nichols | 482/137 |
| 5,487,712 | 1/1996 | Kann | 482/97 |
| 5,626,548 | 5/1997 | Coyle | 482/137 |
| 5,628,715 | 5/1997 | Simonson | 482/97 |

*Primary Examiner*—John Mulcahy
*Attorney, Agent, or Firm*—Knoble & Yoshida LLC

[57] ABSTRACT

An exercise apparatus for exercising the entire body, but in particular the muscles of the legs and the buttocks includes a frame, a lower leg support that has a rearward facing surface for supporting a lower leg area of a user, and a yoke member. The yoke member has a rearward portion that is constructed and arranged to be gripped for lifting by a user, and a forward portion that is pivotally mounted to the frame at a location that is positioned forward of said rearward facing surface of the lower leg support. The apparatus also includes resistance structure for imparting resistance against lifting the rearward portion of said yoke member by the user. This apparatus is particularly suited for doing "lunge" exercises in a way that is both more efficient in the working of targeted muscle groups and is less stressful on the user's knee joints than conventional free weight based lunge exercises are.

11 Claims, 4 Drawing Sheets

EXERCISE DEVICE

BACKGROUND OF THE INVENTION

1. Field of the Invention

This invention relates generally to the field of health and physical fitness, and more specifically to the topic of exercise equipment and techniques.

2. Description of the Related Technology

Exercises known as "lunges" are commonly performed by athletes in order to strengthen the quadriceps and hamstring muscles of the legs, the gluteus muscles of the buttocks and the muscles of the back, shoulders and arms by standing in place while holding dumbbells or a barbell and then stepping backward with one leg, then forward again. In this motion, the athlete's torso drops and his or her knees will bend into a crouching position as the one leg steps back, and the muscles of the buttocks and legs are used to bring the body back up and forward as the athlete rises and steps forward again. Specifically, the muscles of the leg are primarily used to cause the upward motion, while the muscles of the butt are used to generate the forward motion.

When an athlete is performing lunges with weights, the primary direction of the resistance is down, because of gravity. In order for the athlete to focus the weight on the muscles of the buttocks, however, the direction of the resistance must move in the same path as the joint that the those muscles are working, which is the hip joint. The hip joint tends to move in a 45 degree angle down and back, then up again, returning to the starting position. Accordingly, although lunge exercises are probably the most effective exercise that can be performed with free weights to provide focused exercise to the muscles of the buttocks, the mechanics of the exercise are simply not effective in transmitting the resistance that is derived from free weights to the selected muscles.

Clearly a need exists for a system and method for exercising the muscles of the buttocks that is more effective than systems and method heretofore known at efficiently transmitting resistance force to those muscles during exercise.

SUMMARY OF THE INVENTION

Accordingly, it is an object of the invention to provide a system and method for exercising the muscles of the buttocks that is more effective than systems and method heretofore known at efficiently transmitting resistance force to those muscles during exercise. In order to achieve the above and other objects of the invention, an exercise apparatus for to exercising the entire body, but in particular the muscles of the legs and the buttocks, includes a frame; a yoke member, the yoke member having a rearward portion that is constructed and arranged to be gripped for lifting by a user and a forward portion that is pivotally mounted to the frame at a location that is positioned forwardly of where the lower leg of a user will be positioned during exercise; and resistance structure for imparting resistance against lifting the rearward portion of the yoke member by the user.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
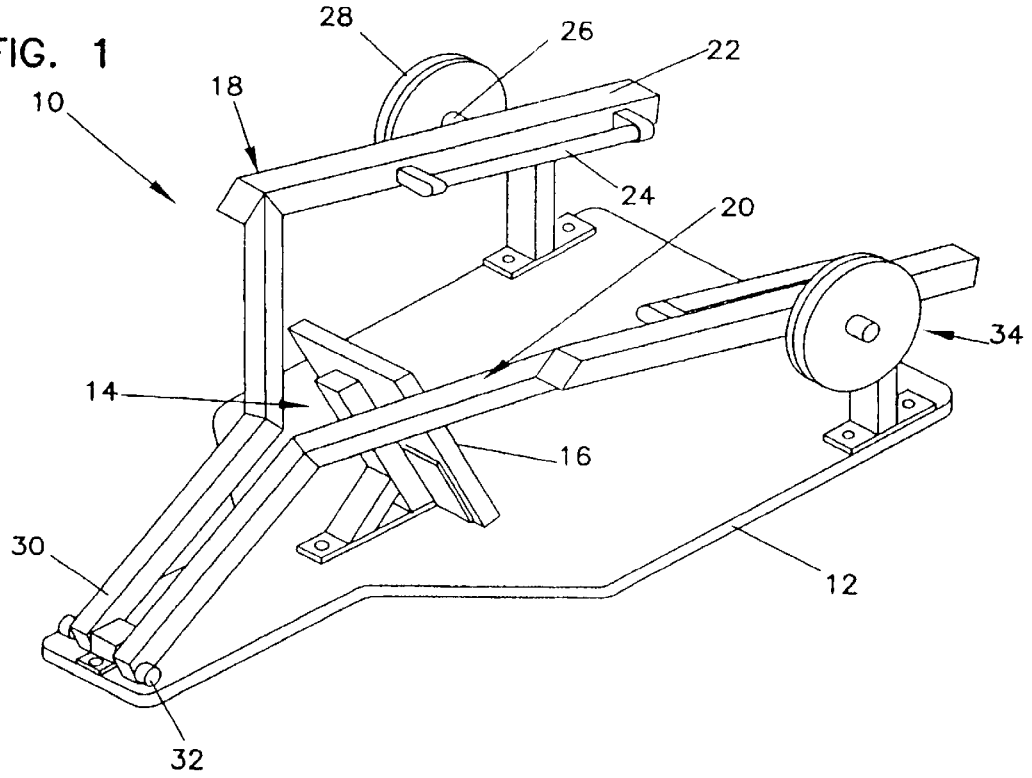
FIG. 1 is an exercise apparatus that is constructed according to a first preferred embodiment of the invention.
Figure 2:
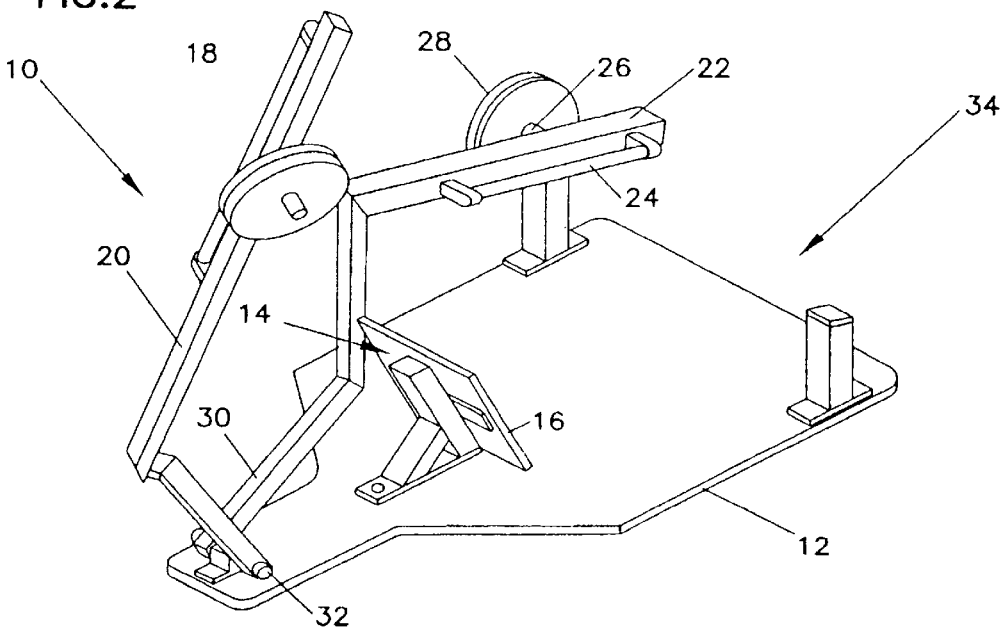
FIG. 2 is the apparatus depicted in FIG. 1, shown in a second operative position.
Figure 3:
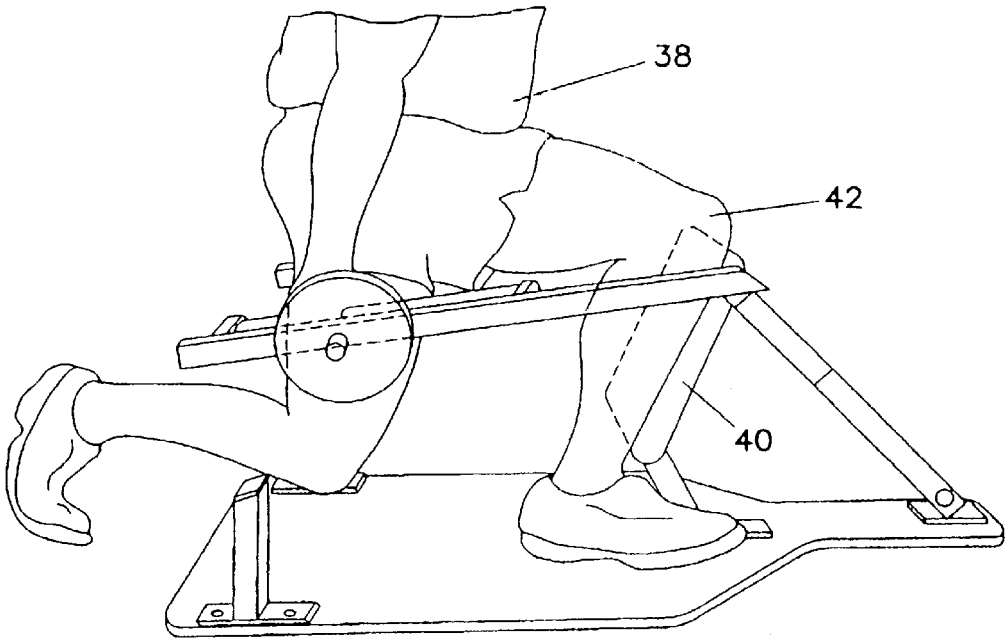
FIG. 3 is the apparatus of FIG. 1, shown in use in a first step of a lunge exercise technique.
Figure 4:
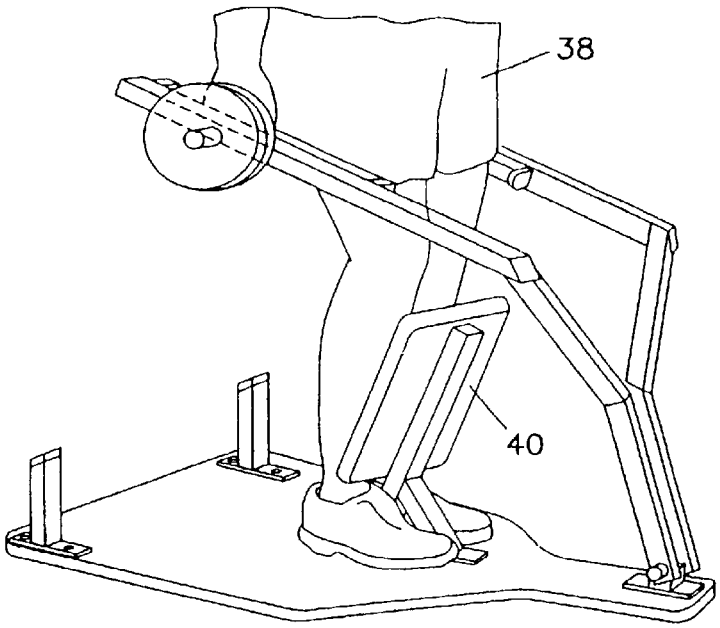
FIG. 4 is the apparatus of FIG. 3, shown in use in a second step of a lunge exercise technique.

Referring now to the drawings, wherein like reference numerals designate corresponding structure throughout the views, and referring in particular to FIG. 1, an exercise apparatus 10 for exercising the entire body, but in particular the muscles of the legs and the buttocks, includes, according to a preferred embodiment of the invention, a frame 12 and a lower leg support 14 that is connected to the frame and has a rearward facing surface 16 for supporting a lower leg area of a user. As may be better seen in FIG. 3, the lower leg support structure 14 is preferably configured so as to support a shin 40 and/or knee 42 of the athlete 38 during use.

Looking again to FIG. 1, exercise apparatus 10 further includes a pair of yoke members 18, 20, each of which includes a rearward portion 22 that is constructed and arranged to be gripped for lifting by a user and a forward portion 30 that is pivotally mounted to the frame 12 at a location that is positioned forwardly of the rearward facing surface 16 of the lower leg support structure 14. As can clearly be seen in FIG. 1, each of the first and second yoke members includes a gripping handle 24 provided at the rearward portion 22, and further includes resistance structure 34 for imparting resistance against lifting the rearward portion 22 of the respective yoke member 18, 20 by an athlete. In the illustrated embodiment, the resistance structure 34 is fashioned as a mount 26 that is suitable for placing one or more free weights 28 that have a predetermined weight.

Referring further to FIG. 1, it will be seen that exercise apparatus 10 further includes a pair of yoke rests 36 connected to frame 12 for eliminating downward rotation of the rearward portion of the respective yoke members 18, 20. In the preferred embodiment, the yoke rests 36 are constructed and arranged so that downward rotation of the rearward portion of the respective yoke member 18, 20 is limited at a predetermined distance above an underlying support surface so as to be grippable by an athlete at arms length when the athlete's arms are at his or her sides. Most preferably, this distance is within a range of about six inches to about eight inches.

Figures 5A, 5B, 5C:
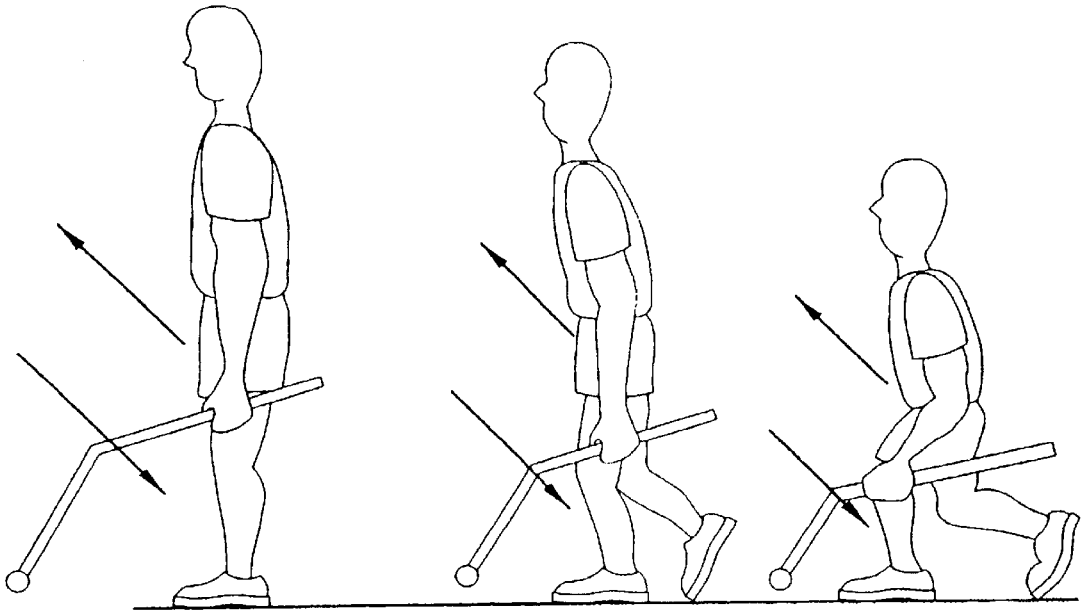
FIGS. 5*a* through 5*f* are diagrammatical depictions of a complete lunge exercise according to the invention.
Figures 5D, 5E, 5F:
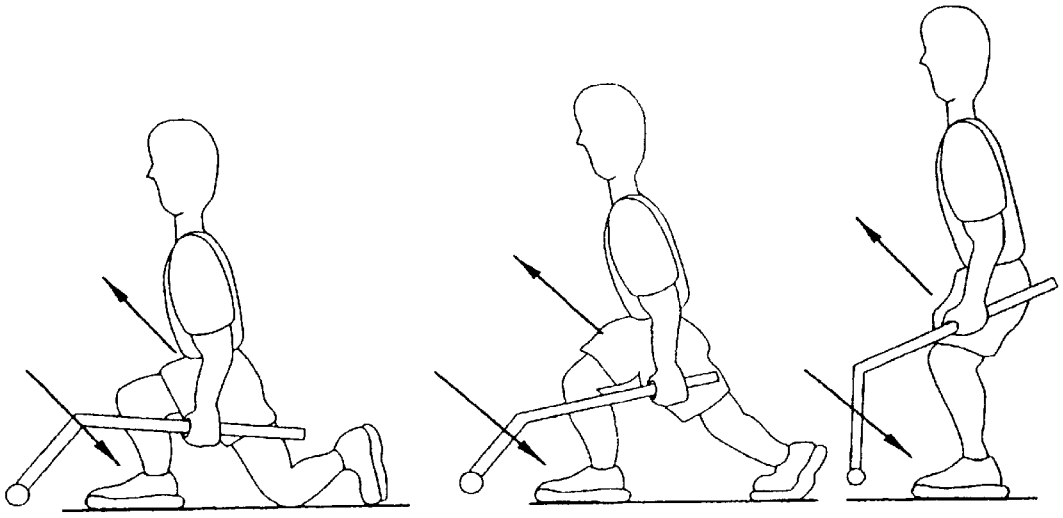
Figure 6:
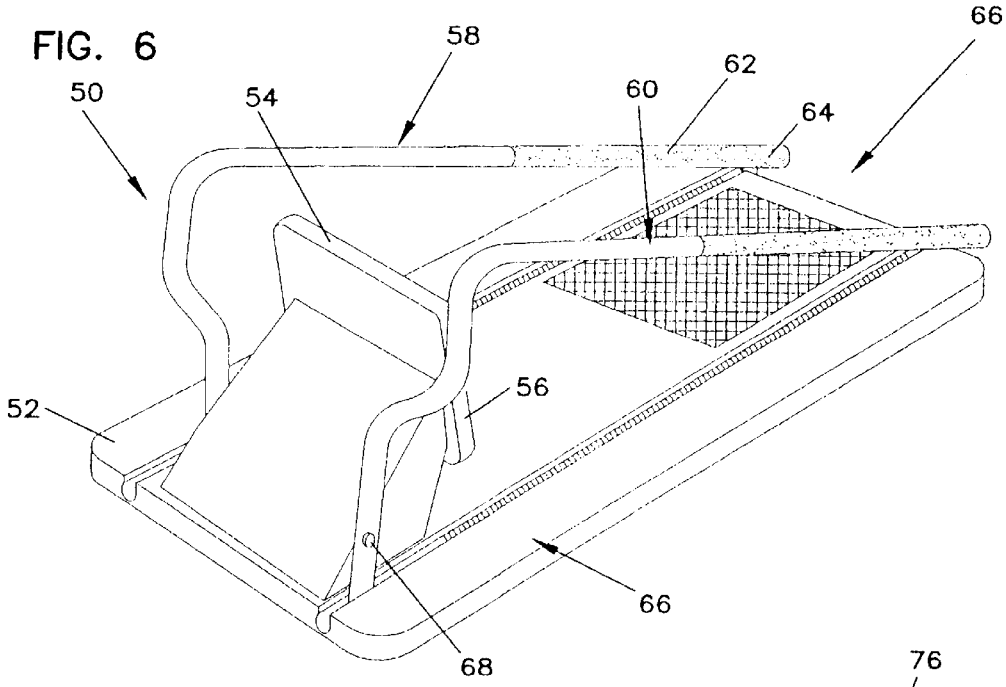
FIG. 6 is an exercise apparatus that is constructed according to a second preferred embodiment of the invention.
Figure 7:
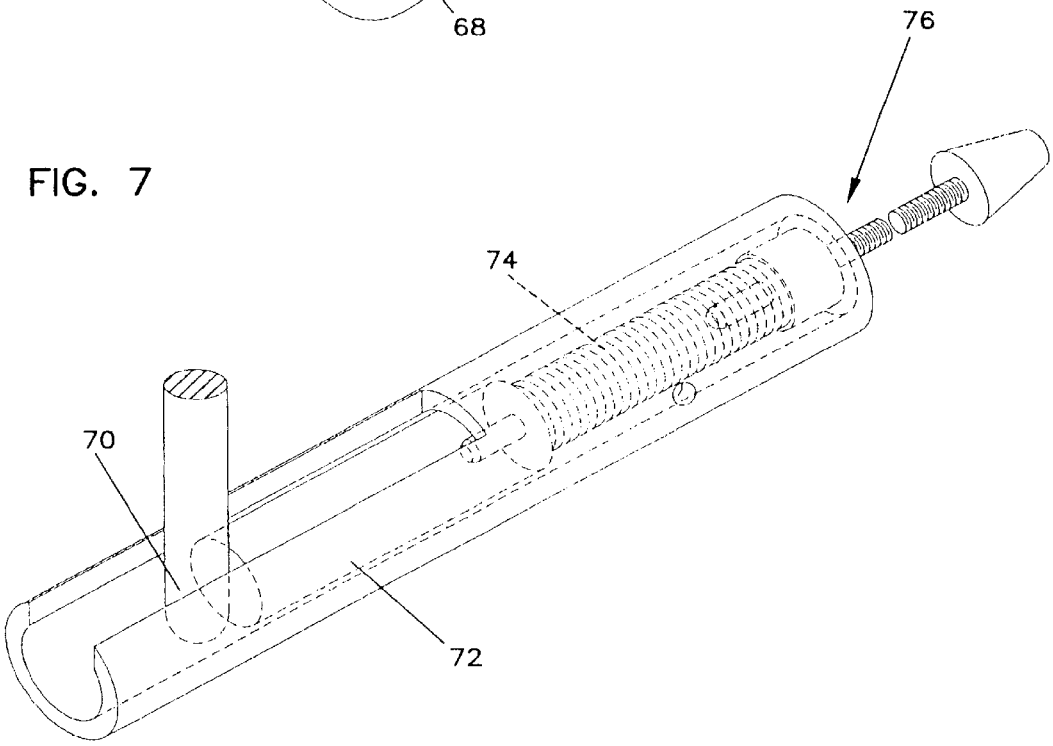
FIG. 7 is an assembly diagram of a portion of the apparatus that is depicted in FIG. 6.

The second embodiment of the invention is depicted with reference to FIGS. 6 and 7 of the drawings. In this embodiment, the exercise apparatus 50 includes a support frame 52, a lower leg support structure 54 that is connected to the frame 52 and that has a rearward facing surface 56 for supporting a lower leg area, preferably the shin area, of a user, and a pair of yoke members 58, 60, each of which includes a rearward portion 62 having a handle 64, much in the manner that has been described above with reference to the embodiment of FIGS. 1–5.

In this embodiment of the invention, the yoke members 58, 60 are pivotally mounted to frame 52, and resistance structure 66 is provided which is preferably embodied as a resilient biasing system for biasing the respective yoke members 58, 68 against rotation about the pivot point 68. As may be seen in FIGS. 6 and 7, the resistance structure 66 includes a lower cam portion 70 at the forwardrmost end of the respective yoke members 58,60, which are positioned to bear against a pin 72 that is mounted for longitudinal movement within a track that is formed within the frame 52. Movement of the pin 72 within the track is constrained by the presence of a compression spring 74, thereby providing a resilient biasing against lifting and rotation of the yoke members 58, 60. Resistance structure 66 further includes an adjustment mechanism 76 for precompressing the spring 74 by a desired amount in order to adjust the resistance that is provided against lifting of the yoke members 58, 60.

In operation, the user will first grip the handles 24, 64 of the opposing yoke members 18, 20 or 58, 60, as is shown in diagrammatically in FIG. 5*a* of the drawings. In order to perform the desired exercise, the user will then step back with one foot and go in to a semicrouching position where both knees are bent, with one leg behind the other, as is shown diagrammatically in FIGS. 5*b* and 5*c*. This crouch may be consummated with the lower knee touching the ground, as shown in FIG. 5*d*. The user will then lift his or her self out of the crouching position, as is shown in FIG. 5*e*, by using his or her quadriceps, hamstrings, and the muscles of the buttocks to the position shown in FIG. 5*f*, as the rearmost leg is again extended by stepping forward. Because the pivoting motion of the yoke members include an added horizontal force component that it is not limited to a downward force, as it would be if free weights were being used, the force of resistance is better concentrated in the gluteus muscles of the buttocks, thus providing enhanced training for those muscles.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An exercise apparatus for exercising the entire body, but in particular the muscles of the legs and buttocks, comprising:

a frame;

a yoke member, said yoke member having a rearward portion that is constructed and arranged to be gripped for lifting by a user and a forward portion that is pivotally mounted to said frame at a location that is positioned forwardly of where the lower leg of a user will be positioned during exercise;

lower leg support means connected to said frame, said lower leg support means having a rearward facing surface for supporting a front area of the lower leg of the user, wherein said yoke member is pivotally mounted to said frame at a position that is forward of said rearward facing surface of said lower leg support means; and resistance means for imparting resistance against lifting said rearward portion of said yoke member by the user.

2. An exercise apparatus according to claim 1, further comprising a yoke rest, connected to said frame, for limiting downward rotation of said rearward portion of said yoke member.

3. An exercise apparatus according to claim 2, wherein said yoke rest is constructed and arranged so that downward rotation of said rearward portion of said yoke member is limited at a distance above an underlying support surface so as to be grippable by the user at arm's length when the user's arms are at the user's sides.

4. An exercise apparatus according to claim 3, wherein said distance above an underlying support surface is within the range of about six inches to about eight inches.

5. An exercise apparatus according to claim 1, wherein said rearward facing surface of said lower leg support means is inclined so as to conform to an intended shin angle of the user during exercising.

6. An exercise apparatus according to claim 5, wherein said lower leg support means is adjustable enabling the user to adjust the degree of incline of said rearward facing surface.

7. An exercise apparatus according to claim 1, wherein said yoke member comprises a gripping handle at said rearward portion.

8. An exercise apparatus according to claim 1, wherein said resistance means comprises means on said yoke member for permitting free weights to be mounted thereon.

9. An exercise apparatus according to claim 1, wherein said resistance means comprises resilient biasing means for biasing said yoke member against rotation.

10. An exercise apparatus according to claim 9, wherein said resilient biasing means comprises a spring member that is operatively interposed between said yoke member and said frame.

11. An exercise apparatus according to claim 9, wherein said biasing means is adjustable.

* * * * *